US005231706A

United States Patent [19]

Kendall

[11] Patent Number: 5,231,706

[45] Date of Patent: Aug. 3, 1993

[54] SANITARY FIXTURES

[76] Inventor: Desmond M. Kendall, 121 Brillinger Street, Richmond Hill, Ontario L4C 8X8, Canada

[21] Appl. No.: 778,127

[22] PCT Filed: Jun. 13, 1990

[86] PCT No.: PCT/CA90/00193

§ 371 Date: Dec. 10, 1991

§ 102(e) Date: Dec. 10, 1991

[87] PCT Pub. No.: WO91/00398

PCT Pub. Date: Jan. 10, 1991

[30] Foreign Application Priority Data

Jun. 28, 1989 [CA] Canada ..... 604283

[51] Int. Cl.[5] ..... E03D 1/26; E03D 11/02; E03D 11/18

[52] U.S. Cl. ..... 4/329; 4/420; 4/421

[58] Field of Search ..... 4/300, 329, 353, 417, 4/418, 419, 420, 421, 425, 430, 431, 432, 434, 441, 442

[56] References Cited

U.S. PATENT DOCUMENTS

| | | | |
|---|---|---|---|
| 2,089,775 | 8/1937 | Wexelberg et al. | 4/300 |
| 3,591,868 | 7/1971 | Owens | 4/300 |
| 3,843,977 | 10/1974 | Garnett | 4/421 |
| 4,041,554 | 8/1977 | Gregory et al. | 4/420 |
| 4,145,772 | 3/1979 | Whitney et al. | 4/300 |
| 4,162,548 | 7/1979 | Groombridge et al. | 4/300 |
| 4,310,934 | 1/1982 | Hennessy et al. | 4/425 X |
| 4,376,314 | 3/1983 | Iwans | 4/420 X |
| 5,010,602 | 4/1991 | Sargent et al. | 4/329 X |

FOREIGN PATENT DOCUMENTS

| | | | |
|---|---|---|---|
| 2343615 | 3/1975 | Fed. Rep. of Germany . | |
| 138622 | 7/1966 | New Zealand . | |
| 155796 | 7/1970 | New Zealand . | |
| 191573 | 12/1982 | New Zealand . | |
| 192921 | 12/1982 | New Zealand . | |
| 191623 | 5/1983 | New Zealand . | |
| 192817 | 5/1983 | New Zealand . | |
| 0004448 | of 1892 | United Kingdom | 4/430 |
| 511873 | 8/1939 | United Kingdom . | |
| 644561 | 10/1950 | United Kingdom . | |
| 907592 | 10/1962 | United Kingdom . | |

*Primary Examiner*—Henry J. Recla
*Assistant Examiner*—Robert M. Fetsuga
*Attorney, Agent, or Firm*—Frishauf, Holtz, Goodman & Woodward

[57] ABSTRACT

A sanitary fixture constructed from at least inner (1) and outer (45, 50, 61) shell sections formed from any suitable material such as a plastics material. The inner shell (1) has an upwardly facing concave basin portion (1A) and is supported on a cradle like member (30). The supported inner shell (1) provides structural integrity for the fixture and the remaining components of the fixture are carried essentially by the supported inner shell. The cradle like support (30) has a bottom section (31) for attachment to a supporting base, a top section (33) that engages the undersurface of the basin, and an intermediate section (32) interconnecting the top and bottom sections together. The supported inner shell provides structural integrity for the fixture whereby the outer shell section of the fixture which extends downwardly form an upper rim (10) of the basin, is essentially non-load bearing and thereby capable of being removed from fixture servicing or for substitution with a replacement shell of a different color, texture, design or material. The bottom section of the cradle like support can be made detachable (60, 78, 70) from the remainder of the support for ease of removal and installation of the fixture over a down pipe located in a floor.

5 Claims, 3 Drawing Sheets

SANITARY FIXTURES

FIELD OF INVENTION

This invention relates to sanitary fixtures such as commodes, toilets, water closets, bidets, sinks, wash basins, urinals and drinking water fountains and more particularly such fixtures made from interconnecting shells that include at least an inner shell and an outer shell and wherein the inner shell is supported providing structural integrity for the fixture. Fixtures of the present invention can be constructed from a number of interconnecting shell sections which themselves can be formed from any suitable material such as a plastics material, or various combinations or sub-combinations of a plastics material, ceramic or metal.

BACKGROUND OF INVENTION

Monolithic heavy-walled sanitary fixtures are well known in the art. Garnett in U.S. Pat. No. 3,843,977 issued Oct. 29, 1974 when disclosing his sanitary fixtures constructed from a plurality of plastic "shell" sections, discusses in some detail the inherent difficulties when constructing and designing sanitary fixtures made from ceramic materials, and the advantages gained therefore by producing a similar fixture constructed from a plurality of interconnected plastic shell sections.

The fixture as disclosed by Garnett employs an inner bowl or basin which is connected to a water trap. A two part rim member is used for discharging rinse water into the bowl or basin. The rim member is also connected to a base, wall or skirt element which exteriorly surrounds and obstructs the underside of the basin and water trap from view.

The various above described relatively thin-walled shell sections are interconnected providing an inner shell and an outer shell spaced apart so as to provide an internal cavity. When the fixture is inverted, this internal cavity is open at the top readily permitting pouring in a settable filler.

In order to structurally permanently interconnect the various shell sections, and in order to support same, Garnett teaches one to charge the internal cavity with a core material, such as water curing concretes and cements, or structural foam materials.

Because the internal cavity of the fixture must be filled for structural integrity and support, the "shell" fixture as disclosed by Garnett, given the inclusion of core material, and notwithstanding one of his intended objects, still remains undesirably heavy. Further, since the core material is required for structural integrity and support, its presence inhibits or restricts one's ability or freedom to create novel design or appearance features and include them in the area of the base or skirt section of the fixture.

Neither the Garnett type of "shell" fixture, nor the well known ceramic fixtures, are capable of having their external appearance features changed after assembly or fabrication. Additionally, while the colour of an existing sanitary fixture may be changed by painting, this is not normally regarded as practical or suitable by decorators, and when redecorating, it is not uncommon for one to replace the entire fixture with one displaying a new colour or new overall design, or both.

In German Patent Specification DE-A-23 43 615 which was laid open for inspection on Mar. 13, 1975, the plastic toilet bowl fixture therein disclosed comprises a metal frame, which is horseshoe shaped, and which is attached to a floor. A plastic pedestal part, at its lower end is supported by the sidewalls of the frame, and at its upper end, receives a plastic bowl section. The pedestal and bowl are interconnected under tension by means of a leaf spring extending across the frame and a screw and an adjustment nut arrangement that connects the bowl to the leaf spring. As disclosed, the greatest mechanical stress imparted to the fixture is experienced when the front or leading edge of the bowl is subjected to heavy loading. In order to prevent large stresses between the pedestal and bowl at this point, provision for relative motion or shifting between the pedestal and the bowl at their point of contact is disclosed, and is considered necessary in order for the neighbouring zones to take up part of the load. Given the above described spring biased tensioning means, and the purposely permitted movement between the pedestal and the bowl, this unwanted movement or flexure may be regarded as unacceptable to many who want or require a stable or solid fixture which, of course, is characteristic of ceramic fixtures of this type.

SUMMARY OF INVENTION

Sanitary fixtures constructed in accordance with this invention retain all of the construction attributes characteristic of "shell" fixtures as disclosed by Garnett, but do not require the use of core material in the cavity permanently joining the sections for structural or support purposes. In application's fixtures, the outer shell which provides the base or skirt portion of the fixture is not a structural member, as is the case with ceramic fixtures, or as is the case with Garnett. Because of this, greater latitude is allowed by the present invention in designing the appearance of the fixture's exterior base, sidewall or skirt. Moreover, as provision can also be made for separating the outer shell in the skirt or base from the remainder of the fixture, after final assembly, it is possible to remove it in the filed and replace it with a substitute skirt of a different material, or with one exhibiting a different colour, design, or texture. Hence the necessity of disposing of an original fixture in its entirety can be avoided.

Similarly, and in keeping with this invention, where the fixture is to function as a conventional toilet having an attached water tank, a removable cover jacket for the associated water tank can be provided, and similarly replaced with a substitute jacket cover in order to compliment the design, colour, material or texture of a replacement shell which is being used for the base or skirt of the fixture. The provision of a cover jacket for the water tank also enables one to change the water capacity of interior water tank without in any way altering the outward design appearance of the fixture and its jacketed water tank reservoir.

While any suitable plastics material is the preferred type of material to be used when constructing the shell sections, given various building codes or simply different parochial habits or traits, and in keeping with this invention, it is also possible for the fabricator to use substitute shell materials and colours. For example, the concave shell or basin, if desired, can be of stainless steel, while other tastes or requirements may dictate that convex shell or basin be of ceramic material.

The versatility imparted to sanitary fixtures of this invention over that which has gone on before is achieved by having the structural integrity for the fixture provided by supporting the inner shell. The utilization of a novel support is located substantially centrally and internally of the fixture and carries the weight of the fixture and any additional load applied to it. Through the use of this supporting means, the outer shell forming the base or sidewall of the fixture effectively becomes a none, or only nominally, load bearing member, meaning its use is now only principally cosmetic.

The non-load bearing outer shell is made removable for servicing and/or for substitution by a replacement shell which forms the exposed to view base portion of the fixture. Provision can also be made for a preferably removable kick or scuff plate, located at the bottom or lowermost portion of the outer shell. This plate can be of a different colour from the remainder of the shell, if colour accenting is desired in this area. Furthermore, as this is an area exposed to abrasion and chemical reagents resulting from repeated floor cleaning, the lower exposed portion of a plastics material shell can be better protected using a preferably removable kick or scuff plate of more resistant material, such as stainless steel.

Sanitary fixtures of the present invention are constructed from interconnecting shell members formed from any suitable material, and include an inner shell having an upwardly facing concave basin portion for receiving waste material, means for discharging a supply of water into said concave basin portion, exit means for the outflow of water and waste material from said basin portion, and an outer shell providing an exterior wall or skirt extending downwardly. The inner shell is mounted, preferably removably mounted, on a cradle like support means located interiorly of said exterior wall and is provided with a bottom section which is intended to be attached to a supporting base, such as a floor or wall. The support means also includes a top section which engages the underside surface of the concave portion of the inner shell and which is held in fixed and spaced apart relationship from the bottom section of the support by an intermediate section.

The weight of the fixture and any loads applied to it are thus carried directly by this centrally disposed support means. Since toilets and bidets traditionally have an oval shaped basin, applied loads to these types of fixtures are not necessarily confined to the central area of the basin and as a result, the bottom section of the support, in order to accommodate for off-center loading, may be made elongate so as to extend in the same longitudinal direction as the major axis of the oval.

As indicated above, the interconnecting exterior shell, which provides a skirt forming what can otherwise be visually regarded as the fixture's base, can be readily detached from the remainder of the fixture, and when desired, substituted with a replacement. Its ability to be removable also facilitates ease of servicing the fixture should leaks arise in its internal connections, or with its associated down pipe, to which it is attached.

The exit means comprises a discharge outlet in the bottom of the concave portion of the inner shell that connects to the inlet end of a water trap conduit. The water trap is mounted on support means for the inner shell and because of the location of the support means, the outlet end of the water trap conduit can advantageously extend through or terminate at a first aperture provided in the bottom section of the support means.

Preferably, the inner shell and the water trap conduit are formed as separate members, using suitable plastic materials. In this configuration, and regardless of the shell material selected, in order to ensure a positive interconnection between the discharge outlet of the concave portion of the inner shell and the inlet end of the water trap conduit, a second aperture can be provided and located in the intermediate section of the support means. The intermediate section of the support means, at its second aperture location, can thus again advantageously carry means for clamping joining in water tight relation a portion of the inner shell that provides the discharge opening for the concave portion of the shell and the inlet end of the water trap conduit.

In accordance with a further embodiment of this invention, the intermediate section of the support means can include two spaced apart upwardly directed support walls which are perpendicular to and which extend in a direction parallel to the bottom section. The top section of the support means in this arrangement can then include concave shell engaging means on the top of each of the support walls so that the support means can be physically attached to the underside of the concave shell, such as by gluing or mechanical fastening. As an alternative, the underside of the concave shell may also be provided with top section receiving means, such as flanges or the like, so that the support means itself can be detachably secured to the basin employing, for example, securing bolts. It will also be recognized that it is possible, using suitable materials, to mold the concave shell together with its support means as a single, integral, shell section.

In accordance with yet another embodiment of my invention, and in order to facilitate installation or removal of the fixture, the supporting means can also include means for releasing at least one part of the support means from the remainder of the fixture to which it is attached. By way of example, the base section of the support means can be made disengageable from the intermediate section, so that the base section can first be secured to the floor without obstruction, and then the fixture, carrying the intermediated and top sections, can be placed in position over the base section, and physically secured or attached to it, employing, for example, disengageable latching means, carried on either the base or intermediate sections.

While the need for a structural core material within the underside cavity between the inner and outer shells of the fixture has, in accordance with this invention, been dispensed with, it will be recognized that all or part of this cavity can be filled or stuffed with a non-structural damping material, such as glass fiber. Glass fiber, being compressible, is ideally suited where the base, skirt or sidewall shell is being replaced with one or smaller size.

BRIEF DESCRIPTION OF DRAWINGS

The invention is illustrated by way of example in the accompanying drawings wherein.

DETAILED DESCRIPTION OF PREFERRED EMBODIMENTS

Figure 1:
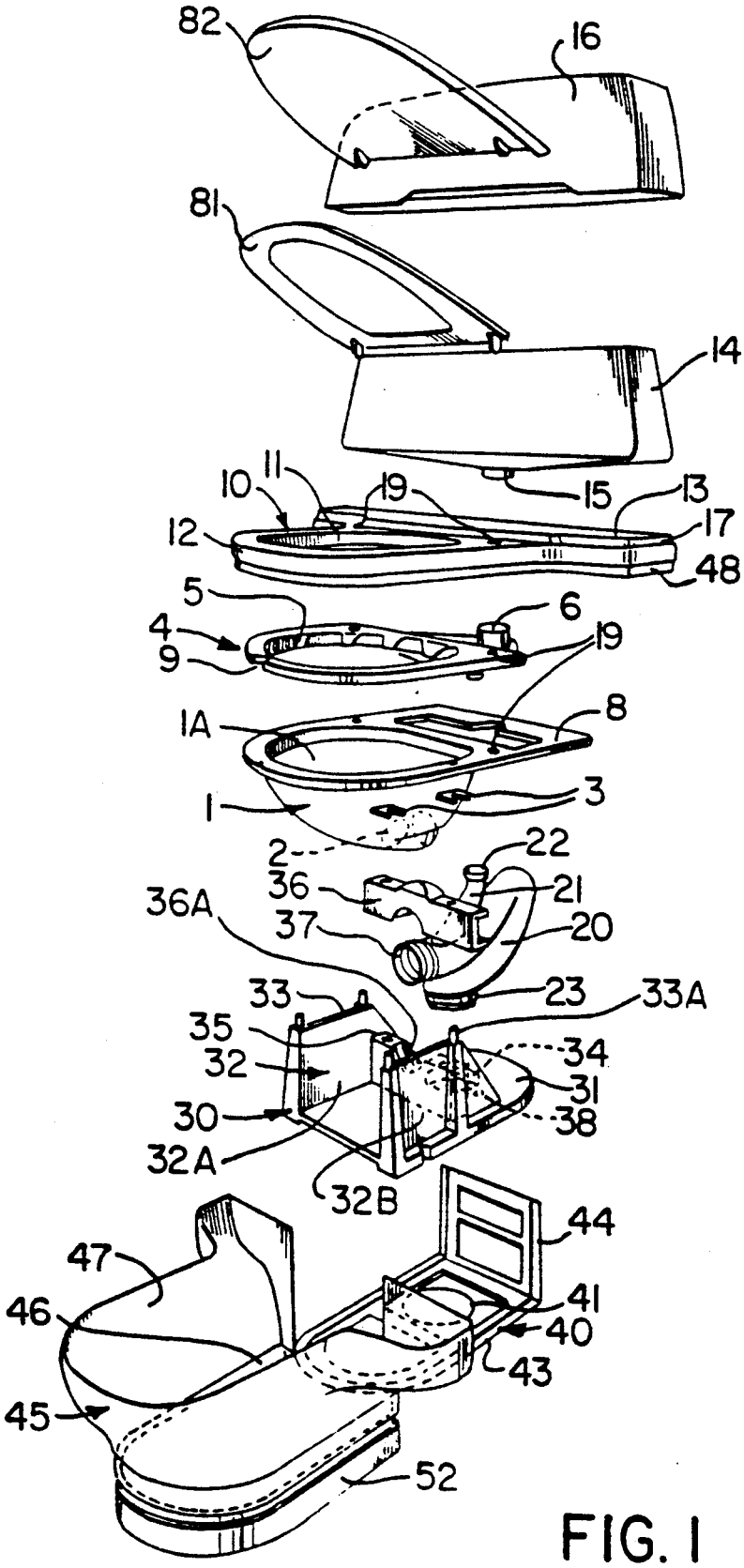
FIG. 1 is an exploded perspective view of a water closet wherein the removable outer shell providing the skirt is open at the rear of the fixture.
Figure 2:
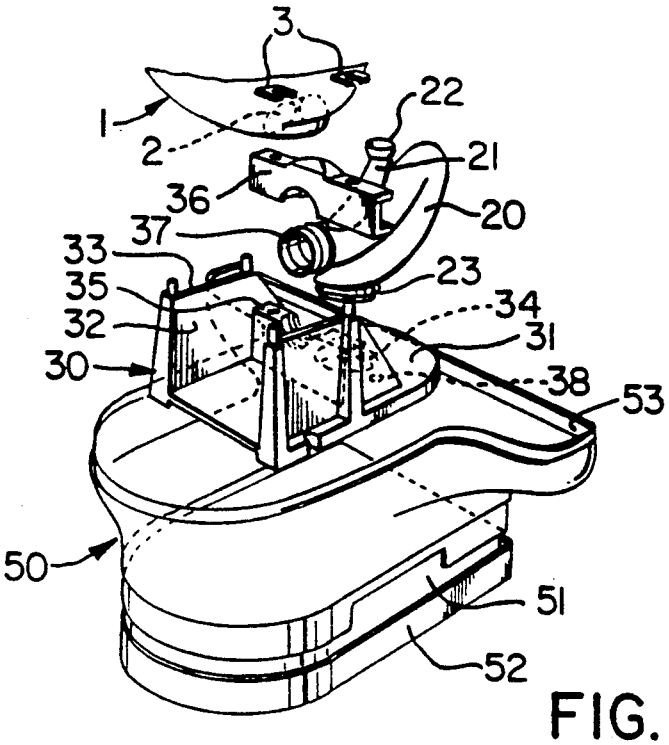
FIG. 2 is a view similar to the lower portion of FIG. 1, but where the skirt extends entirely around the fixture.
Figure 3:
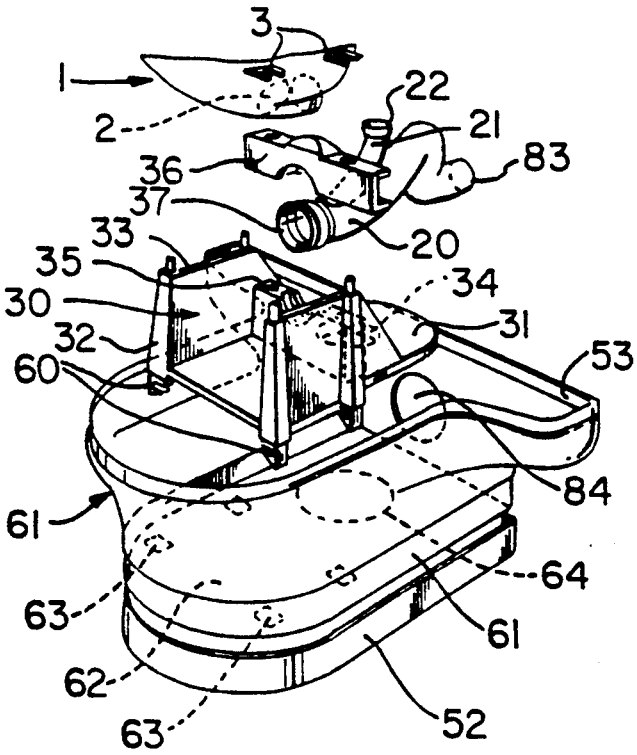
FIG. 3 is a view similar to that of FIG. 2, but illustrates a support means where the upper portion is detached from its base member.

With reference to FIGS. 1, 2 and 3, for ease of understanding, the same reference numerals have been used to denote like parts.

Each fixture illustrated includes an inner shell 1 having an upwardly facing concave portion providing a basin 1A for receiving water and waste material that is capable of being discharged through exit opening 2 positioned in the bottom of the basin, a cradle like support means 30 disposed under and supporting the inner shell and an outer shell 45 that provides a skirt for the fixture. Flanges 3 extending outwardly from the underside of basin 1A may be provided for securing the basin to the supporting means 30, as discussed in greater detail below.

A water distribution manifold 4, having annular opening 5 of a somewhat smaller diameter than that of the upper portion of basin 1A, is positioned over the basin. This manifold, which is hollow, is provided with a water inlet 6 and a plurality of water discharge orifices arranged about annular opening 5.

The water manifold is secured to ledge 8 located at the top of the basin 1A by any suitable means, such as gluing. Provision can also be made for securing the basin to the manifold by means of bolts or the like in selected areas, such as area 9 being an indent in the manifold.

An upper rim 10, having inner and outer rim edges 11 and 12, respectively, is positioned over manifold shell 4 and concave shell 1 so that inner rim edge 11 and outer rim edge 12 overly the manifold and obstruct annular opening 5 of the manifold and ledge 8 of the basin from view. As before, the upper rim 10 can be secured in position by any suitable means such as by gluing. Where desired or appropriate, a seat 81 and seat cover 82 can be fixed to rim 10 employing securing holes 19 provided in the rim, manifold and ledge for this purpose.

As best seen in FIG. 1, the rearward part of the upper rim carries with it an elongate depression 13 for receiving a bottom portion of a water tank 14 that is supported in a position above ledge 8. Pipe opening 15 in the bottom of the tank connects with water inlet 6 of the manifold in a manner well known in the art (not shown). The water supply tank 14 is itself obstructed from view by cover jacket 16 and located in position on rim 10 by lip 17.

As also seen in FIGS. 1, 2 and 3, the exit means for the outflow of water and waste material from the basin includes a water valve in the form of "P" trap 20, the function of which is also well known in the art. As shown, the trap also includes anti-siphon conduct 21 which at one end communicates with the interior of the trap, and at the other, is provided with water inlet 22. Inlet 22 is attached to the underside of water distribution manifold 4 and again functions in a manner well known in the art and serves to promote waste water discharge during a water flush. The trap discharge opening 23, as seen in FIGS. 1 and 2, is intended to be connected to a down pipe carried by a supporting base and on which the fixture is to be positioned (not shown).

With reference to FIGS. 1 and 2, support means 30 for the fixture, as illustrated, includes bottom section 31 which is preferably elongate for imparting stability to the sanitary fixture, intermediate section 32 and top section 33. As will be apparent, the top section of the support means effectively is a cradle for the basin which if desired can be positively attached to projection flanges 3 on basin 1 employing any suitable type of fastening means such as pins 33A or attachment bolts (not shown). The intermediate section 32 includes two spaced apart support walls designed, respectively, 32A and 32B.

Advantageously, and in order to locate discharge opening 23 of trap 20 in fixed position and for attachment to a down pipe on the supporting base, a circular opening 34 or aperture in base 31 can be provided, thus permitting water trap 20 with discharge opening 23 to project therethrough. The other end of the conduit that provides trap 20 can also be advantageously held in fixed water tight relation with exit opening 2 in basin 1, by means of a further opening 36A or aperture in the intermediate section. As illustrated, transverse parts 35 and 36 of the intermediate section can be joined together by means of fastening bolts or the like (not shown) in order to positively clamp and effect a water tight fit between opening 2 of the basin and inlet opening 37 of trap 20. Thus, when in its assembled condition, and if desired, the fixture essentially consisting of the basin, trap, manifold and upper rim as well as the support means attached to the basin can be physically positioned as a joined together unit over a down pipe and attached to its support base, such as a floor, by for example, screws, bolts or the like using attachment holes 38 provided for this purpose in the base of the mounting cradle like means 30.

Referring specifically to the fixture seen in FIG. 1, the above described assembly is positioned over a floor plate 40 located on a supporting base (not shown). This plate includes annular opening 41 supporting a down pipe (not shown), and over which opening 23 of trap 20 is to be aligned and attached in a known manner.

The perimeter portion of floor plate 40 is flared upwardly and outwardly as seen at 43 for reasons which will be apparent from that which follows, and at its rear, includes an upstanding panel or shell section 44. Panel 44 in conjunction with removable skirt 45 serves to mask off from view the inner assembly of the fixture.

As illustrated, the lower edge of skirt 45 is provided with an inwardly extending flange 46 which can be slid below or otherwise positioned below the upwardly and outwardly flared part 43 of plate 40. The upper edge 47 of skirt 45, on the other hand, is contoured so as to matingly engage a recess 48 extending about the lower edge of outer rim 12, and securement thereto can be by any suitable sealing material which, if required, will permit the skirt to be separated form the upper rim. If desired, the juncture of the wall providing recess 48 with the outer rim edge 12 can be provided with a downwardly facing groove for receiving the upper peripheral edge of the outer shell 45.

In the FIG. 2 arrangement, and as illustrated, outer shell 50 that provides the skirt is fabricated as a single shell section which envelopes all of the remaining parts of the fixture below the upper rim 10. If desired, skirt 50 may also include an integral or separate sub-floor 62 as seen in FIG. 3. Access holes 51 (FIG. 2) can be provided on either side of the skirt and if desired, can be closed off in any suitable manner such as employing a removable kick or scuff plate 52 as shown. In this particular fixture illustration, skirt 50 along its upper edge 53 is recessed and configured so that the edge 53 is disposed interiorly of outer rim edge 12 of rim 10. During installation, the skirt is located in the desired position and the remainder of the fixture then positioned therefore; the interior portion of the fixture then being attached to a supporting base employing attachment holes 38 with access thereto being gained through openings 51. Where replacement of the skirt is undertaken, the foregoing procedure is simply reversed.

Referring now to FIG. 3, it will be seen that top and intermediate sections 33 and 32 of the support means 30 are similar to the corresponding parts illustrated in FIG. 2. It will be also apparent, however, that locking fingers 60 extend downwardly therefrom. The outer shell 61, as before, is provided with an indented upper edge 53 which is cancealed from view when brought into registry with outer edge 12 of rim shell 10. Also as shown, shell 61 is provided with an integral or separate sub-floor 62 which imparts lateral stability to the skirt proximate its bottom area, and is also provided with openings 63 through which locking fingers 60 can extend. A circular opening shown by broken line 64 can also be provided in the sub-floor, the purpose of which is to permit the discharge opening 23 of trap 20 to extend through the sub-floor and in order to effect coupling to a down pipe as previously described. However, and as illustrated in FIG. 3, trap 20 extends rearwardly of the fixture and terminates at outlet end 83; this end extending through circular opening 84 provided int he skirt. External connections to horizontal outlet 83 are commonly employed in European water closet and North American bidet installations.

Figure 4:
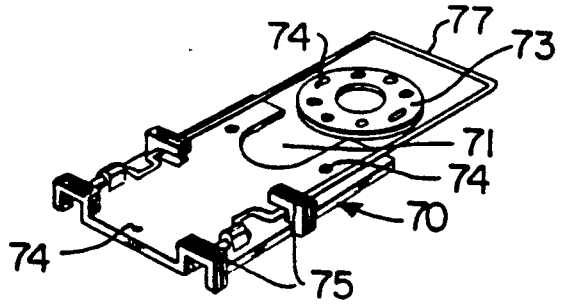
FIGS. 4 and 5 are oblique views illustrating the base member component used with the upper portion of the supporting means seen in FIG. 3.
Figure 5:
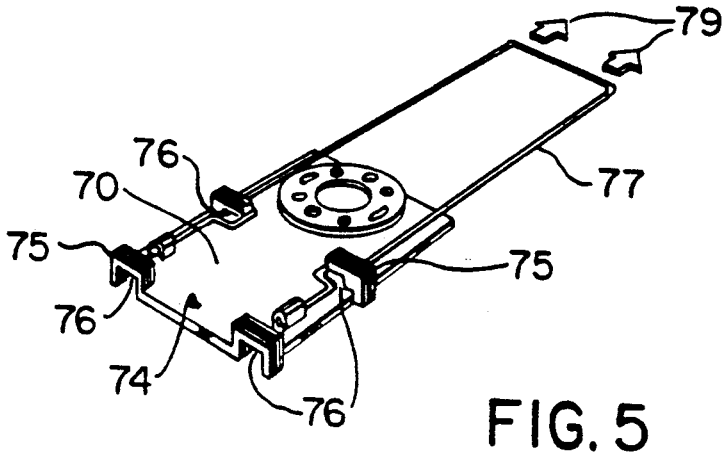
Figure 6:
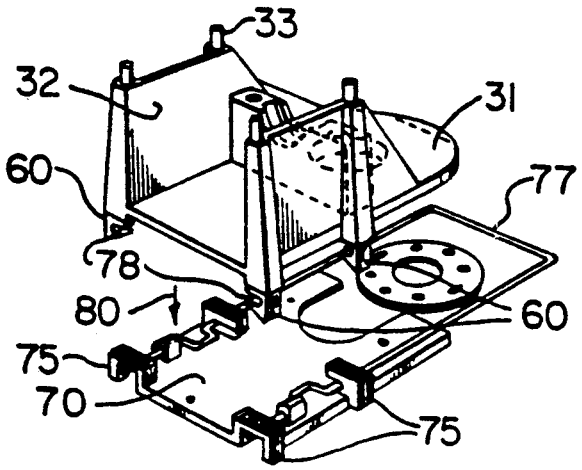
FIG. 6 is an exploded oblique view illustrating the detachable locking arrangement of the base member to the remainder of the supporting means.

The detachable engagement feature of the support means seen in FIG. 3 is best illustrated with reference to FIGS. 4, 5 and 6 where the bottom section 31 of the support means 30 includes a locking plate 70. As seen in FIG. 4, locking plate 70 has a semi-circular cut-out 71 and can be moved in the direction towards and so as to engage the underside of collar 73 of a down pipe to which the collar is attached. Plate 70 is then physically secured to a supporting base and the collar 73 employing attachment holes 74 for this purpose.

Four locking finger receiving receptacles 75 for receiving locking fingers 60 of member 30 are carried by or molded into plate 70 as illustrated, and on their innermost sides relative to the plate include cut-out sections 76 through which the free ends of "U" shaped wire or rod 77 extend. As each locking finger is provided with a notch 78 (see FIG. 6), when the rod is pulled in the direction of arrow 79, receptacles 75 are unobstructed by the rods so that entry of fingers 60 is facilitated. This enables fingers 60 to be inserted into the receptacles as seen from direction arrow 80 of FIG. 6. Once nestled within these receptacles, the "U" shaped wire rod is moved in a direction reverse to arrow 79, thereby locking the two components together.

In order to separate skirt 61 from the remainder of the fixture seen in FIG. 3, all that is required is to disengage locking fingers 60 form plate 70 as descried above, and thereafter, separate the skirt from the remainder of the unit. As before, the bottommost portion of the shirt can include a removable scuff or kick plate 52, but since the fixture can be separated from its floor attachment simply by pulling the disengagement rod (which extends outwardly of the rear of the fixture), no unsightly access or attachment protuberances need appear in the sidewall or skirt portion of the fixture.

While the subject invention has been described in context of a water closet or toilet, it will be apparent to anyone skilled in the art that this invention has equal application to other forms of sanitary fixtures.

I claim:

1. In a sanitary fixture of the type which is adapted to be secured to a floor and which is constructed from a plurality of interconnected plastic members that include an inner shell-like member forming a waste and water receiving basin which has a discharge opening proximate a bottom thereof, a water trap conduit having an inlet end connected to said discharge opening and an outlet end for connection to a waste down pipe located in said floor, an upper member at least forming a rim about a top of said basin, and an outer shell-like member spaced apart from and forming an exterior wall about an underside of said basin and which is sized to extend from said upper member to said floor, the improvement comprising:

(a) said outer member being essentially a non-load bearing member and being removably connected to said upper member; and (b) support means for securing said fixture to the floor and for positively and firmly supporting substantially all of the weight of the fixture and any weight applied to the fixture during use thereof, said support means being separately located interiorly of said outer member and further including:

(i) an elongate bottom section for fixedly securing said support means to the floor;

(ii) a first aperture in said bottom section permitting the passage of the outlet end of said water trap conduit therethrough;

(iii) two spaced apart support walls which respectively extend upwardly from an elongate side of said bottom section and which relative to said water trap conduit, are located on either side thereof;

(iv) means for securing each of said support walls to said underside of said basin.

2. The sanitary fixture as claimed in claim 1, wherein said water trap conduit at its said inlet end is connected to said discharge opening at said second aperture.

3. The sanitary fixture as claimed in claim 2, wherein said transverse wall includes means for joining said discharge opening and said inlet end of said water trap conduit together in a water tight relationship.

4. The sanitary fixture as claimed in claim 1, wherein said means for securing includes co-operating inter-engagement means on the underside of said basin and on an upper part of each of said support walls for removably securing each of said support walls to said underside of said basin.

5. The sanitary fixture as claimed in claim 4, wherein said inter-engagement means includes flanges on said underside of said basin.

* * * * *